US011371418B2

(12) United States Patent
Kodama

(10) Patent No.: US 11,371,418 B2
(45) Date of Patent: Jun. 28, 2022

(54) INTERNAL COMBUSTION SYSTEM

(71) Applicant: TOYOTA JIDOSHA KABUSHIKI KAISHA, Toyota (JP)

(72) Inventor: Yasuaki Kodama, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/399,341

(22) Filed: Aug. 11, 2021

(65) Prior Publication Data

US 2022/0056834 A1 Feb. 24, 2022

(30) Foreign Application Priority Data

Aug. 18, 2020 (JP) ..... JP2020-137917
Jan. 22, 2021 (JP) ..... JP2021-008561

(51) Int. Cl.

| | |
|---|---|
| ***F01P 11/14*** | (2006.01) |
| ***F02D 41/00*** | (2006.01) |
| ***F01P 5/10*** | (2006.01) |
| ***F01P 3/00*** | (2006.01) |

(52) U.S. Cl.

CPC ..... *F01P 11/14* (2013.01); *F01P 3/00* (2013.01); *F01P 5/10* (2013.01); *F01P 2003/001* (2013.01); *F01P 2025/08* (2013.01)

(58) Field of Classification Search

CPC .. F02D 41/064; F01P 2031/30; F01P 2037/02
See application file for complete search history.

(56) References Cited

U.S. PATENT DOCUMENTS

2003/0041593 A1* 3/2003 Yoshida ..... F02D 41/042 60/285
2010/0063710 A1* 3/2010 Asai ..... F02D 41/064 701/103
2013/0055802 A1* 3/2013 Takahashi ..... F01N 11/002 73/114.68
2014/0023107 A1* 1/2014 Furuta ..... G01N 25/72 374/4

(Continued)

FOREIGN PATENT DOCUMENTS

JP 2009087825 A 4/2009

*Primary Examiner* — Long T Tran
(74) *Attorney, Agent, or Firm* — Dickinson Wright, PLLC

(57) ABSTRACT

An internal combustion system capable of exactly determining timing of exchanging a coolant of an engine. The internal combustion system includes an engine, cooling circulation mechanism circulating the coolant containing ethylene glycol to the engine while cooling it, temperature sensor measuring the temperature of the coolant having passed through the engine, and control device. The control device includes a number of cold starts counting unit determining engine cold start and counting the number of cold starts before coolant exchange, an accumulated amount of time measuring unit measuring an accumulated amount of time when the coolant temperature measured by the temperature sensor is a defined temperature or higher before the coolant exchange, and an exchange determination unit determining the need for coolant exchange, when the accumulated amount of time is a defined amount of time or greater and the number of cold starts is a defined number of times or greater.

3 Claims, 9 Drawing Sheets

(56) References Cited

U.S. PATENT DOCUMENTS

| | | | | |
|---|---|---|---|---|
| 2014/0288736 | A1* | 9/2014 | Martin | F02N 11/0829 903/903 |
| 2016/0333829 | A1* | 11/2016 | Takahashi | F02D 41/005 |
| 2018/0058248 | A1* | 3/2018 | Reigl | F01D 19/02 |
| 2018/0068497 | A1* | 3/2018 | Kurtz | G01S 19/13 |
| 2018/0283221 | A1* | 10/2018 | Reigl | F16K 37/0083 |

* cited by examiner

INTERNAL COMBUSTION SYSTEM

CROSS REFERENCE TO RELATED APPLICATIONS

The present application claims priority from Japanese patent application JP2020-137917 filed on Aug. 18, 2020 and Japanese patent application JP 2021-008561 filed on Jan. 22, 2021, the entire content of which is hereby incorporated by reference into this application.

BACKGROUND

Technical Field

The present disclosure relates to an internal combustion system including an engine.

Background Art

Internal combustion systems including an engine as a power source and a control device that controls the engine have conventionally been proposed. The engine generates a high-temperature heat due to combustion of a fuel-air mixture during the operation. Thus, a coolant is introduced into the engine so that the coolant is circulated by a cooling circulation mechanism to be delivered to the engine.

Some of such coolants to be used may include ethylene glycol for freeze prevention. However, ethylene glycol may be oxidatively degraded under an environment at a temperature exceeding 80° C. in some cases. This produces an organic acid such as a formic acid or an acetic acid in the coolant, which could corrode the passage where the coolant flows.

As a system that controls such a coolant, a system is disclosed that accumulates the amount of time when the temperature of the coolant is equal to or higher than a given temperature, and determines the degradation of the coolant when the accumulated amount of time has reached a defined amount of time.

SUMMARY

The system shown in JP 2009-087825 A accumulates the amount of time when the temperature of the coolant is equal to or higher than a given temperature to measure the oxidative degradation of the coolant (ethylene glycol) at high temperatures; however, in some cases, the degradation of the coolant does not depend on the accumulated amount of time, thus failing to exchange the coolant at appropriate timing.

The present disclosure has been made in view of the foregoing and provides an internal combustion system that can more exactly determine the timing of exchanging the coolant of the engine.

The inventor's elaborate study made in view of the foregoing has confirmed that the oxidative degradation of the ethylene glycol contained in the coolant at high temperatures correlates with the amount of dissolved oxygen in the coolant. Specifically, a novel finding was obtained that the ethylene glycol in the coolant containing oxygen in a smaller amount dissolved therein is not easily oxidatively degraded even at high temperatures, and the oxygen dissolved in the coolant is more likely to be taken in from an oxygen gas in a gaseous phase when the temperature of the coolant is low.

The present disclosure is based on such a novel finding, and an internal combustion system according to the present disclosure includes: an engine; a cooling circulation mechanism that circulates a coolant to the engine while cooling the coolant, the coolant adapted to cool the engine and containing ethylene glycol; and a temperature sensor that measures a temperature of the coolant having passed through the engine, in which the internal combustion system further includes a control device, the control device having: a number of starts counting unit that determines a cold start of the engine and counts the number of cold starts during a period until the coolant is exchanged; an accumulated amount of time measuring unit that measures an accumulated amount of time when the temperature of the coolant measured by the temperature sensor is equal to or higher than a defined temperature during the period until the coolant is exchanged; and an exchange determination unit that determines that the coolant needs to be exchanged, when the accumulated amount of time is equal to or greater than a defined amount of time and the number of cold starts is equal to or greater than a defined number of times.

According to the present disclosure, the accumulated amount of time measuring unit of the control device measures the accumulated amount of time when the temperature of the coolant having passed through the engine is equal to or higher than the defined temperature. When the accumulated amount of time is equal to or greater than the defined amount of time, the coolant may possibly contain the organic acid due to the oxidative degradation of the ethylene glycol. However, when the coolant contains oxygen in a smaller amount dissolved therein, the ethylene glycol is not significantly oxidatively degraded.

The present disclosure counts the number of cold starts to measure the amount of oxygen dissolved in the coolant. Specifically, since the temperature of the coolant is around the room temperature before starting the cold start, the oxygen gas in the cooling circulation mechanism is likely to be dissolved in the coolant. Therefore, when the number of cold starts is less than the defined number of times, since the coolant may have been used with a fewer amount of oxygen dissolved therein, the actual oxidative degradation of the ethylene glycol may not be significant. In such a case, the coolant may be determined not to be oxidatively degraded and the exchange determination unit may determine that the coolant exchange is unnecessary.

Meanwhile, based on the condition for determination that the number of cold starts counted by the number of starts counting unit is equal to or greater than a defined number of times, when the condition for determination is satisfied, it can be determined that the coolant contains oxygen dissolved therein in an amount sufficient to oxidatively degrade the ethylene glycol. When the condition for determination is satisfied, it can be determined that the coolant is oxidatively degraded (that is, the ethylene glycol is oxidatively degraded), and the exchange determination unit determines that the coolant needs to be exchanged. In this manner, the timing of exchanging the coolant of the engine can be more exactly identified.

Herein, the oxidative degradation of the coolant corrodes a metal forming a flow channel (wall surface of the flow channel) that contacts the coolant. Although an anticorrosive or the like is added to the coolant, when the metal contacting the coolant is susceptible to corrosion, the corrosion is more promoted due to the oxidative degradation of the coolant as compared to other metals, despite addition of the anticorrosive to the coolant. Further, as the area in the flow channel contacting the coolant increases, the anticorrosive added to the coolant is more consumed. As a result, as the oxidative degradation of the coolant progresses, the corrosion-resistance of the metal (wall surface of the flow channel) against the coolant degrades. In such a case, the oxidative degradation of the coolant may be determined at an early stage so as to move up the timing of exchanging the coolant.

In view of the foregoing, in some embodiments, the coolant may further contain an anticorrosive, and the control device may further include a setting unit that sets the defined amount of time and the defined number of times in accordance with the type of metal forming the flow channel where the coolant flows and the contacting area of the metal of the flow channel contacting the coolant.

According to this embodiment, since the defined amount of time and the defined number of times are set in accordance with the type of metal forming the flow channel where the coolant flows and the contacting area of the metal of the flow channel contacting the coolant, the timing of exchanging the coolant can be moved up than normal. This can reduce corrosion of the wall surface of the flow channel due to the coolant oxidatively degraded.

In some embodiments, the control device further includes: a degree of oxidative degradation calculation unit that calculates the degree of oxidative degradation of the coolant on the basis of the accumulated amount of time and the number of cold starts; an additional amount calculation unit that calculates, on the basis of the degree of oxidative degradation, an additional amount of a neutralizer for neutralizing the acidity of the coolant and an additional amount of an anticorrosive for the metal forming the flow channel against the coolant; and a modification unit that modifies the defined amount of time and the defined number of times on the basis of the additional amount of the neutralizer or the anticorrosive after addition of the neutralizer or the anticorrosive.

According to this embodiment, since the additional amount of the neutralizer or the anticorrosive is calculated on the basis of the degree of oxidative degradation of the coolant, the addition of the neutralizer or the anticorrosive in the calculated additional amount can extend the usable period of the coolant so as to delay the timing of exchanging the coolant. Thus, the frequency of the coolant exchange can be reduced.

According to the present disclosure, the timing of exchanging a coolant of an engine can be more exactly determined.

DETAILED DESCRIPTION

Figure 1:
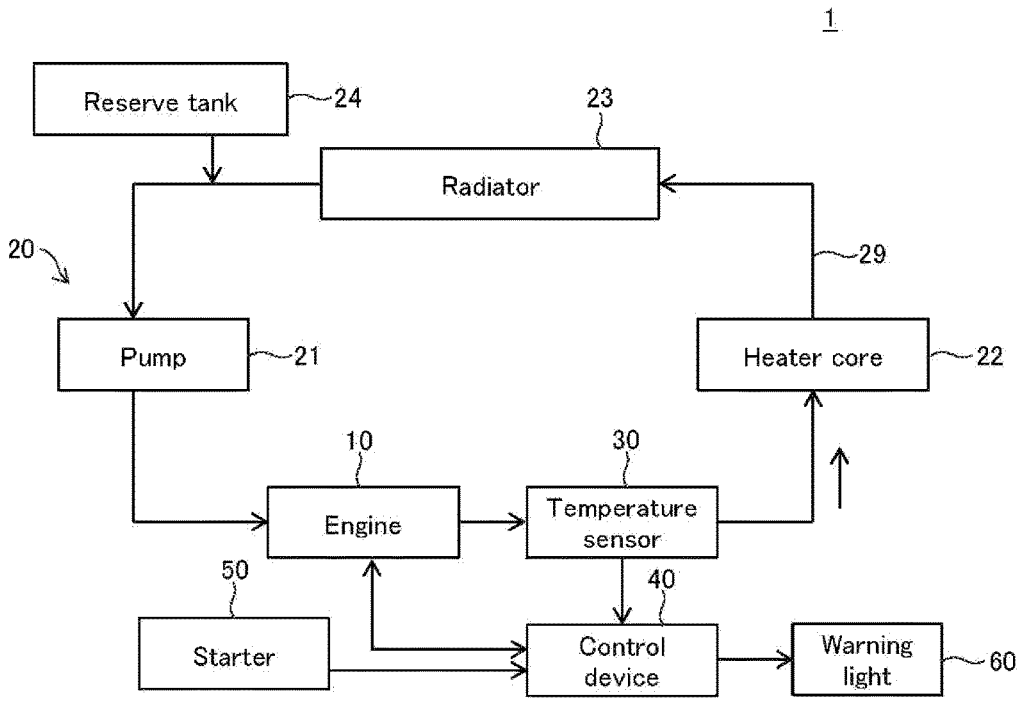
FIG. 1 is a schematic conceptual view of an internal combustion system according to first to third embodiments of the present disclosure.

First to third embodiments according to the present disclosure will be described below with reference to FIG. 1 to FIG. 4. FIG. 1 is a schematic conceptual view of an internal combustion system according to the first to third embodiments of the present disclosure.

As shown in FIG. 1, an internal combustion system 1 according to the present embodiment is to be mounted on a vehicle. The internal combustion system 1 includes an engine 10, a cooling circulation mechanism 20, and a control device 40. The internal combustion system 1 further includes a temperature sensor 30, a starter 50, and a warning light 60.

The engine 10 is a device as a power source of a vehicle. Although the details of the engine 10 are not illustrated below, the engine 10 has a cylinder block in which a piston is slidably disposed, and the cylinder head is provided with an intake valve and an exhaust valve. A mixture of a fuel and an intake air is ignited for combustion in a combustion chamber of the engine 10 so that the engine 10 is driven. Since the engine 10 is heated due to the combustion, a flow channel where a coolant for cooling the engine flows is formed in the cylinder block of the engine 10 in the present embodiment.

In the present embodiment, the coolant is a liquid in which an additive containing ethylene glycol or the like is added to water. The coolant in the present embodiment may contain 25 to 80 percent by mass of ethylene glycol. Addition of the ethylene glycol to the coolant can prevent the coolant from freezing.

The coolant for cooling the engine 10 is circulated to the engine 10 by the cooling circulation mechanism 20, which is a generally-known mechanism. The cooling circulation mechanism 20 includes a pump 21, a heater core 22, a radiator 23, and a reserve tank 24 that are coupled together via piping.

The pump 21 is disposed upstream of the engine 10, and pumps the coolant into the engine 10. Since the engine 10 is heated during the operation, pumping by the pump 21 cools the engine 10.

The aforementioned temperature sensor (water temperature sensor) 30 is disposed downstream of the pump 21. The temperature sensor 30 can measure the temperature of the coolant that has passed through the engine 10. Further, the heater core 22 is disposed downstream of the temperature sensor 30. The heater core 22 absorbs the heat of the coolant through heat exchange while the temperature inside the vehicle is increased.

The radiator 23 is disposed downstream of the heater core 22, and can cool the coolant that has passed through the heater core 22. Further, the reserve tank 24 for storing the coolant is disposed between the radiator 23 and the pump 21. When the coolant to be fed to the pump 21 is in short supply, the coolant is fed from the reserve tank 24. In the present embodiment, the reserve tank 24 is disposed between the radiator 23 and the pump 21, but may be disposed in, for example, the radiator 23 in some embodiments. A flow channel 29 includes a flow channel through which the coolant flows and that is formed in the engine (specifically, cylinder block) 10, the heater core 22, the radiator 23, and the pump 21 that are shown in FIG. 1, and a flow channel inside the piping coupling these components. The flow channel 29 corresponds to the "flow channel for the coolant" of the present disclosure.

The control device 40 controls starting of the engine 10 on the basis of a starting signal from the starter 50, and constantly controls combustion of the engine 10. The control of the engine 10 by the control device 40 is typical control for operating the engine 10, such as an air-fuel ratio control. The detailed description of the control will be omitted herein.

The control device 40 determines the degradation of the coolant. When the control device 40 determines that the coolant is oxidatively degraded, it controls the warning light 60 that prompts the coolant exchange to turn on. The control device 40 is electrically coupled to the temperature sensor 30, and receives a measurement signal of the temperature of the coolant from the temperature sensor 30. The control device 40 includes, a calculation device (not shown) such as a CPU, and a storage device (not shown) such as a RAM and a ROM, as hardware.

First Embodiment

Figure 2:
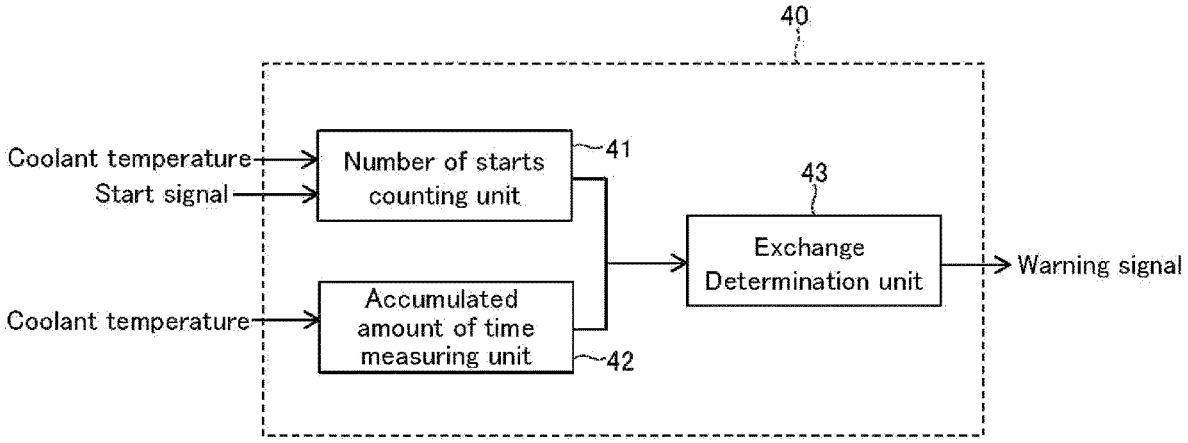
FIG. 2 is a block diagram showing the control of the internal combustion system shown in FIG. 1 according to the first embodiment.

The details of the control device 40 according to a first embodiment will be described below. In the present embodiment, the control device 40 includes, as software, a number of starts counting unit 41, an accumulated amount of time measuring unit 42, and an exchange determination unit 43 that are shown in FIG. 2. It should be noted that since the control of the engine 10 with the software is commonly known, the detailed description of the control will be omitted herein.

The number of starts counting unit 41 determines the cold start of the engine 10 and counts the number of cold starts during the period until the coolant is exchanged. The cold start is the start of the engine 10 at a temperature equal to or lower than the external temperature (ambient temperature). In the present embodiment, the cold start is the start of the engine 10 when the heat input from the engine 10 to the coolant is completely released from the coolant.

For example, the cold start of the engine 10 may be determined at the timing of receiving a starting signal from the starter 50 by comparing the external temperature and the coolant temperature. Further, the cold start of the engine 10 may be determined at the timing of starting the engine 10 after the coolant temperature decreases.

The accumulated amount of time measuring unit 42 measures the accumulated amount of time when the coolant temperature measured by the temperature sensor 30 is equal to or higher than a defined temperature during the period until the coolant is exchanged. Herein, the defined temperature is a temperature at which the ethylene glycol contained in the coolant is oxidatively degraded so that a formic acid or an acetic acid is produced, which is, for example, 80° C.

The exchange determination unit 43 determines that the coolant needs to be exchanged when the accumulated amount of time measured by the accumulated amount of time measuring unit 42 is equal to or greater than the defined amount of time and the number of cold starts counted by the number of starts counting unit 41 is equal to or greater than the defined number of times. Specifically, when the accumulated amount of time is equal to or greater than the defined amount of time and the number of cold starts counted is equal to or greater than the defined number of times, it can be determined that the coolant is oxidatively degraded. In this case, the exchange determination unit 43 determines that the coolant needs to be exchanged. The exchange determination unit 43 transmits a warning signal to prompt the coolant exchange to the warning light 60 on the basis of the determination result.

It should be noted that the defined amount of time (predetermined amount of time) herein may be obtained as follows, for example. Specifically, the coolant containing oxygen in a predetermined amount dissolved therein is heated at the highest temperature at which the coolant has passed through the engine 10, and then, the heating time until the amount of the organic acid such as the formic acid and the acetic acid produced from the ethylene glycol reaches a predetermined amount is measured by conducting experiments or the like in advance, so that the measured heating time may be set as the defined amount of time. In this manner, when the accumulated amount of time measured by the accumulated amount of time measuring unit 42 is equal to or greater than the defined amount of time, the ethylene glycol contained in the coolant may be presumed to be oxidatively degraded.

However, even when the coolant is heated under such a heating condition, the ethylene glycol is not oxidatively degraded in some cases. This point will be described with reference to FIG. 3, which is a graph showing the relation between the total amount of dissolved oxygen and the amount of the organic acid produced.

Herein, the total amount of dissolved oxygen may be estimated by a product of the amount of dissolved oxygen in the coolant and the accumulated amount of time when the temperature is equal to or higher than the aforementioned defined temperature (for example, 80° C. or higher). Specifically, when the amount of the oxygen dissolved in the coolant at a temperature equal to or higher than the defined temperature is small, the total amount of dissolved oxygen relative to the entire coolant is also small. Thus, even when the accumulated amount of time is extended, the total amount of dissolved oxygen remains small. Therefore, the amount of the organic acid produced in the coolant is small. However, it is apprehended that as the amount of dissolved oxygen increases from the predetermined amount, the amount of the organic acid produced in the coolant increases.

Specifically, when the temperature of the coolant reaches a high temperature of 80° C. or higher, the ethylene glycol starts oxidatively degrading, while the dissolved oxygen contained in the coolant is consumed. Meanwhile, during the cold start of the engine 10, the oxygen is taken in from the gas phase (air) inside the cooling circulation mechanism 20 including the reserve tank 24 or the like, so that the amount of dissolved oxygen in the coolant increases. Thus, during the cold start of the engine 10, the coolant is replenished with oxygen and the amount of dissolved oxygen reaches saturation in the defined amount of time.

Thus, in the present embodiment, the exchange determination unit 43 determines that the coolant needs to be exchanged, on the basis of the determination condition that the accumulated amount of time is equal to or greater than the defined amount of time and also when the number of cold starts counted by the number of starts counting unit 41 is equal to or greater than the defined number of times (predetermined number of times).

This enables more exact determination of oxidative degradation of the coolant of the engine, so that the exchange of the coolant containing the organic acid is prompted, thereby being able to suppress corrosion of the wall surface of the flow channel of the engine 10 and cooling circulation mechanism 20 where the coolant passes.

The flow of the control of the internal combustion system of the present embodiment will be described with reference to FIG. 4. In step S1, the engine 10 is started first and the temperature sensor 30 measures the temperature of the coolant. The process proceeds to step S2 where the accumulated amount of time measuring unit 42 determines whether the temperature of the coolant has reached a defined temperature.

Herein, in step S2, when the temperature of the coolant has reached the defined temperature, the process proceeds to step S4 where the accumulated amount of time measuring unit 42 measures the amount of time (specifically, measured time is added). In this manner, the accumulated amount of time measuring unit 42 accumulates the amount of time when the temperature of the coolant is equal to or higher than the defined temperature, so that the accumulated amount of time can be calculated.

Meanwhile, when the temperature of the coolant has not reached the defined temperature, the process proceeds to step S3. In step S3, if measuring of the amount of time in step S4 is already ongoing, the measuring ends, and the measured time is stored. Then, the process returns to step S1.

In step S4, the accumulated amount of time measuring unit 42 calculates the accumulated amount of time and the process proceeds to step S5. In step S5, the exchange determination unit 43 determines whether the accumulated amount of time has reached the defined amount of time. When the accumulated amount of time has reached the defined amount of time, the process proceeds to step S6 where the number of starts counting unit 41 measures the number of cold starts of the engine 10, and the process further proceeds to step S7. Meanwhile, when the exchange determination unit 43 determines that the accumulated amount of time has not reached the defined amount of time, the process returns to step S1 and the measuring of the temperature of the coolant continues.

When the exchange determination unit 43 determines in step S7 that the number of cold starts has reached the defined number of times, it is determined that the ethylene glycol of the coolant is oxidatively degraded and that the coolant needs to be exchanged. Then, the process proceeds to step S8. In step S8, the exchange determination unit 43 transmits a warning signal to the warning light 60 to turn it on. Meanwhile, when the number of cold starts has not reached the defined number of times in step S7, the process returns to step S1 and the measuring of the temperature of the coolant continues. Once the coolant is exchanged, the number of cold starts counted and the accumulated amount of time measured are reset. Then, the flow shown in FIG. 4 is repeated.

Second Embodiment

The internal combustion system according to a second embodiment will be described below. The difference from the first embodiment in the internal combustion system of the second embodiment is the control device. The difference in the control devices will be described below with reference to FIG. 5 to FIG. 8.

Figure 5A:
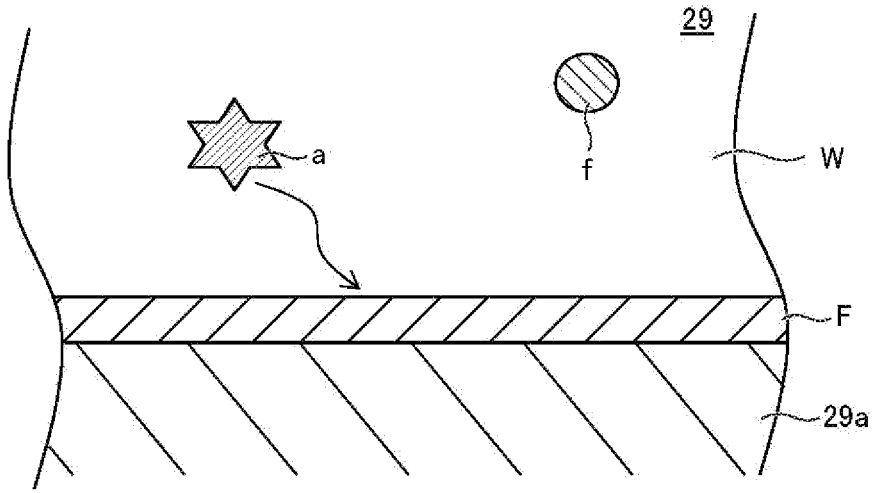
FIG. 5A is a schematic conceptual view for explaining the activity of an anticorrosive in a flow channel where a coolant flows.
Figure 5B:
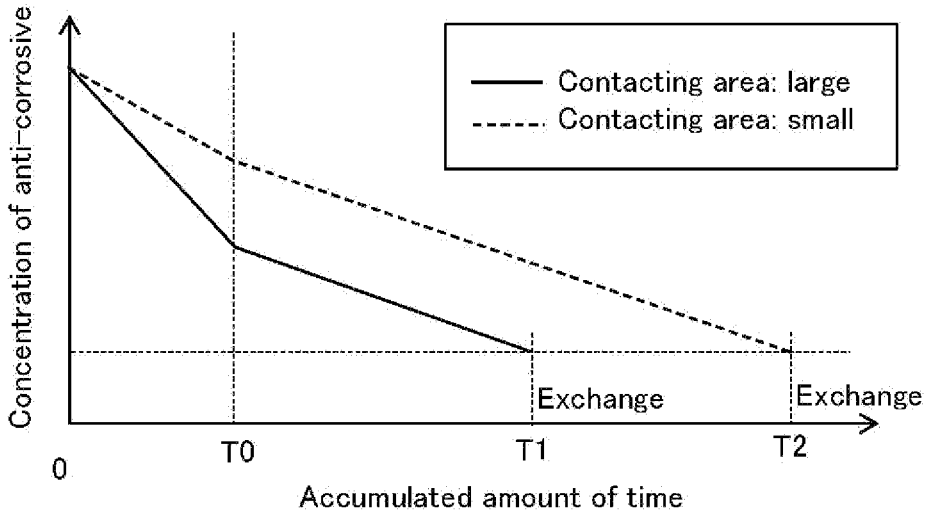
FIG. 5B is a schematic conceptual graph for explaining a change in the concentration of the anticorrosive over time.

First, with reference to FIG. 5A and FIG. 5B, the activity of an anticorrosive contained in the coolant is described. It should be noted that the accumulated amount of time in FIG. 5B is the accumulated amount of time when the coolant is used at high temperatures. In the present embodiment, a coolant W contains an anticorrosive since it flows through a flow channel made of metal. Therefore, as shown in FIG. 5A, when the coolant W containing an anticorrosive f flows through the flow channel 29, an anticorrosive film F is formed on the wall surface of the flow channel 29. This can suppress corrosion of the metal on the wall surface caused by an organic acid a such as a formic acid or an acetic acid.

Examples of the anticorrosive f may include one type or a mixture of two or more types of a phosphoric acid and/or the salt thereof, an aliphatic carboxylic acid and/or the salt thereof, aromatic carboxylic acid and/or the salt thereof, triazoles, thiazoles, silicate, nitrate, nitrite, borate, molybdate, and amine salt. It should be noted that 0.5 to 5.0 percent by mass of the anticorrosive f is added relative to the entire coolant W. When the anticorrosive f is excessively added, the pH (hydrogen ion exponent) of the coolant W is likely to fluctuate.

Herein, as shown in FIG. 5B, the anticorrosive f has the highest concentration before being input to the internal combustion system. After the input, the anticorrosive f of the coolant W is consumed for forming the anticorrosive film F (see T0 of FIG. 5B). Then, in accordance with the oxidative degradation of the coolant W, an anticorrosive film F is attacked by the organic acid or the like of the coolant oxidatively degraded, and the remaining anticorrosive f in the coolant W is consumed for reproducing the anticorrosive film F or the like. As a result, the concentration of the anticorrosive f decreases as the oxidative degradation of the coolant W progresses. Then, the coolant W reaches the time for exchange (see T1 and T2 of FIG. 5B).

In such a case, the flow channel having a larger contacting area with the coolant W consumes more anticorrosive f than those having a smaller contacting area, and accordingly decreases the concentration of the anticorrosive f in the coolant W. Therefore, the timing of exchanging the coolant W flowing through the flow channel having a larger contacting area is earlier than that of the coolant W flowing through the flow channel having a smaller contacting area.

In addition, when the metal contacting the coolant W is susceptible to corrosion, even if the anticorrosive f is added to the coolant W, the corrosion of the metal is more promoted in accordance with the oxidative degradation of the coolant W, as compared to the other metals. In such a case also, the timing of exchanging the coolant W may be moved up.

Figure 6:
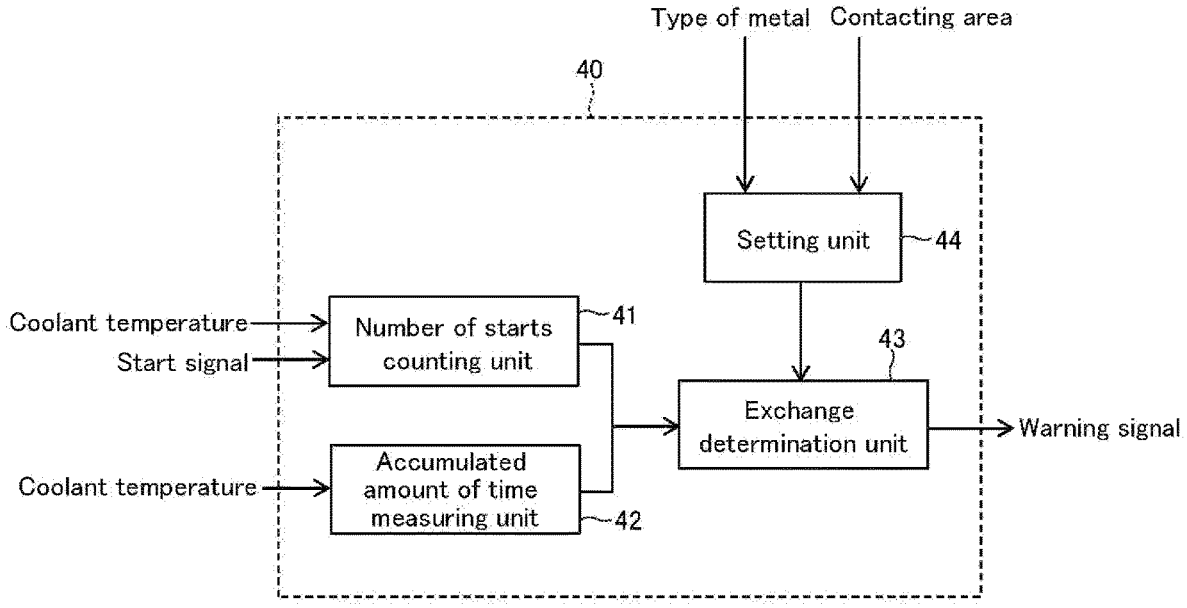
FIG. 6 is a block diagram showing the control of the internal combustion system shown in FIG. 1 according to the second embodiment.

From these points of view, the present embodiment further includes a setting unit 44 that sets the defined amount of time and the defined number of times as thresholds for determination by the exchange determination unit 43 as shown in FIG. 6. The setting unit 44 sets the defined amount of time and the defined number of times in accordance with the type of metal forming the flow channel 29 where the coolant W flows and the contacting area where the metal of the flow channel 29 contacts the coolant W. The set defined amount of time and defined number of times are sent to the exchange determination unit 43, and are used as the thresholds for determining the exchange of the coolant W similarly to the first embodiment.

Figure 7A:
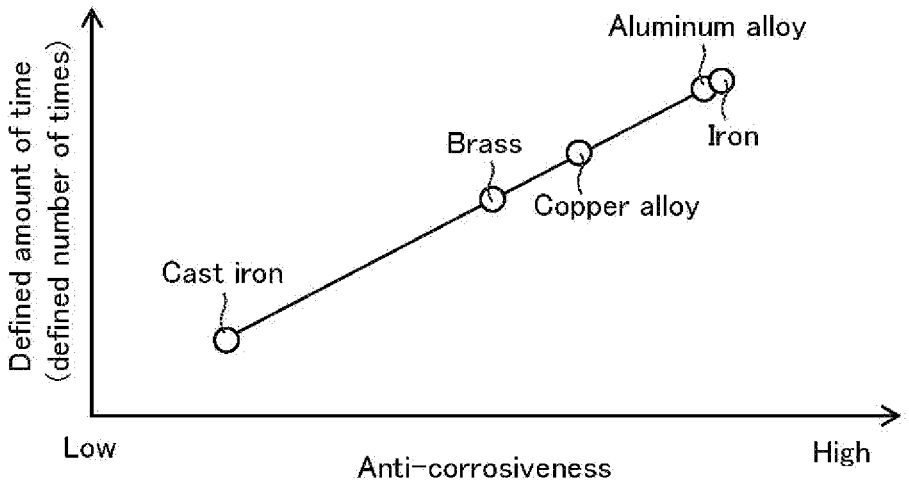
FIG. 7A is a conceptual graph showing the relation between the type of metal of a cooling circulation mechanism, and a defined amount of time and a defined number of times.

The setting unit 44 sets the defined amount of time and the defined number of times so as to be reduced, as the metal contacting the coolant W has a lower anticorrosiveness. Specifically, a plurality of types of metal plates having different materials are immersed in the coolant W oxidatively degraded to measure the reduced amounts of the metal plates due to the corrosion. Then, the degree of anticorrosiveness of each metal forming the metal plate is specified in accordance with the reduced amount, so that the defined amount of time and the defined number of times may be set in accordance with the degree of anticorrosiveness of each type of metal, as shown in FIG. 7A. It should be noted that FIG. 7A shows the degree of anticorrosiveness against the organic acid such as the formic acid and the acetic acid produced when the coolant W is actually oxidatively degraded. The setting unit 44 may change the defined amount of time and the defined number of times by the same ratio in accordance with the degree of anticorrosiveness.

Herein, FIG. 7A shows that cast iron is most susceptible to corrosion (having the lowest anticorrosiveness) as compared to brass, a copper alloy, an aluminum alloy, and iron, for example. In the case in which the metal forming the flow channel 29 is cast iron, the defined amount of time and the defined number of times are set smaller than those when the other metals are used. For example, the defined amount of time and the defined number of times for cast iron may be set by multiplying the defined amount of time and the defined number of times set for iron by the same ratio (ratio less than 1). For the other metals also, the defined amount of time and the defined number of times may be set based on a table, provided in a memory or the like, in which the defined amounts of time and the defined numbers of times for the iron, aluminum alloy, copper alloy, brass, and cast iron are set so as to be reduced in this order.

Figure 7B:
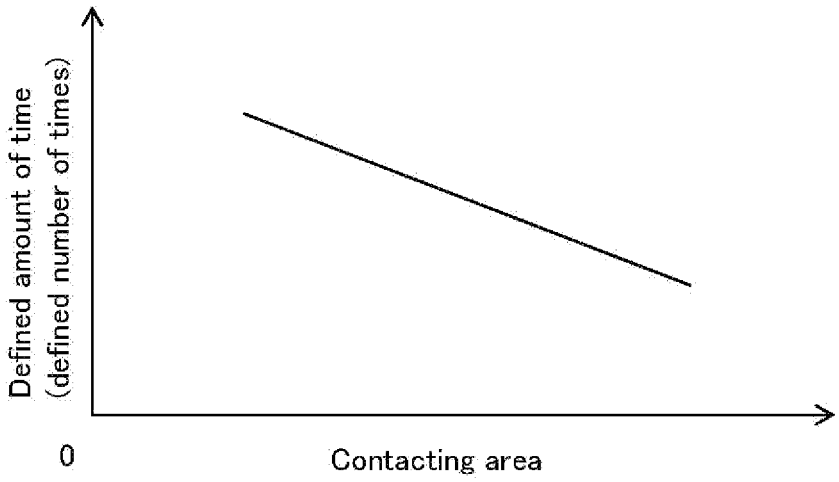
FIG. 7B is a conceptual graph showing the relation between a contacting area of the coolant, and the defined amount of time and the defined number of times.

Specifically, as shown in FIG. 7B, the setting unit 44 sets the defined amount of time and the defined number of times so as to be reduced, as the area of the metal contacting the coolant W increases. Herein, the defined amount of time and the defined number of times may be changed by the same ratio.

The setting unit 44 temporarily sets a standard defined amount of time and defined number of times preset for each type of metal forming the flow channel 29. Then, the defined amount of time and the defined number of times are modified on the basis of the temporarily set standard defined amount of time and defined number of times, in accordance with the contacting area. The setting unit 44 sets the modified defined amount of time and defined number of times as the thresholds for exchanging the coolant W.

When the flow channel 29 includes a plurality of types of metals, before setting the defined amount of time and the defined number of times in accordance with the contacting area, which will be described later, firstly, the standard defined amount of time and defined number of times associated with the most corrosive metal are temporarily set. Then, the defined amount of time and the defined number of times may be set on the basis of the temporarily set standard defined amount of time and defined number of times, in accordance with the contacting area.

In addition, when the flow channel 29 includes a plurality of types of metals, the standard defined amount of time or defined number of times preset for each type of metal is corrected in accordance with the contacting area for each metal. The minimum defined amount of time and defined number of times among the corrected defined amounts of times or defined numbers of times for the metals may respectively be set as the defined amount of time and the defined number of times.

Figure 8:
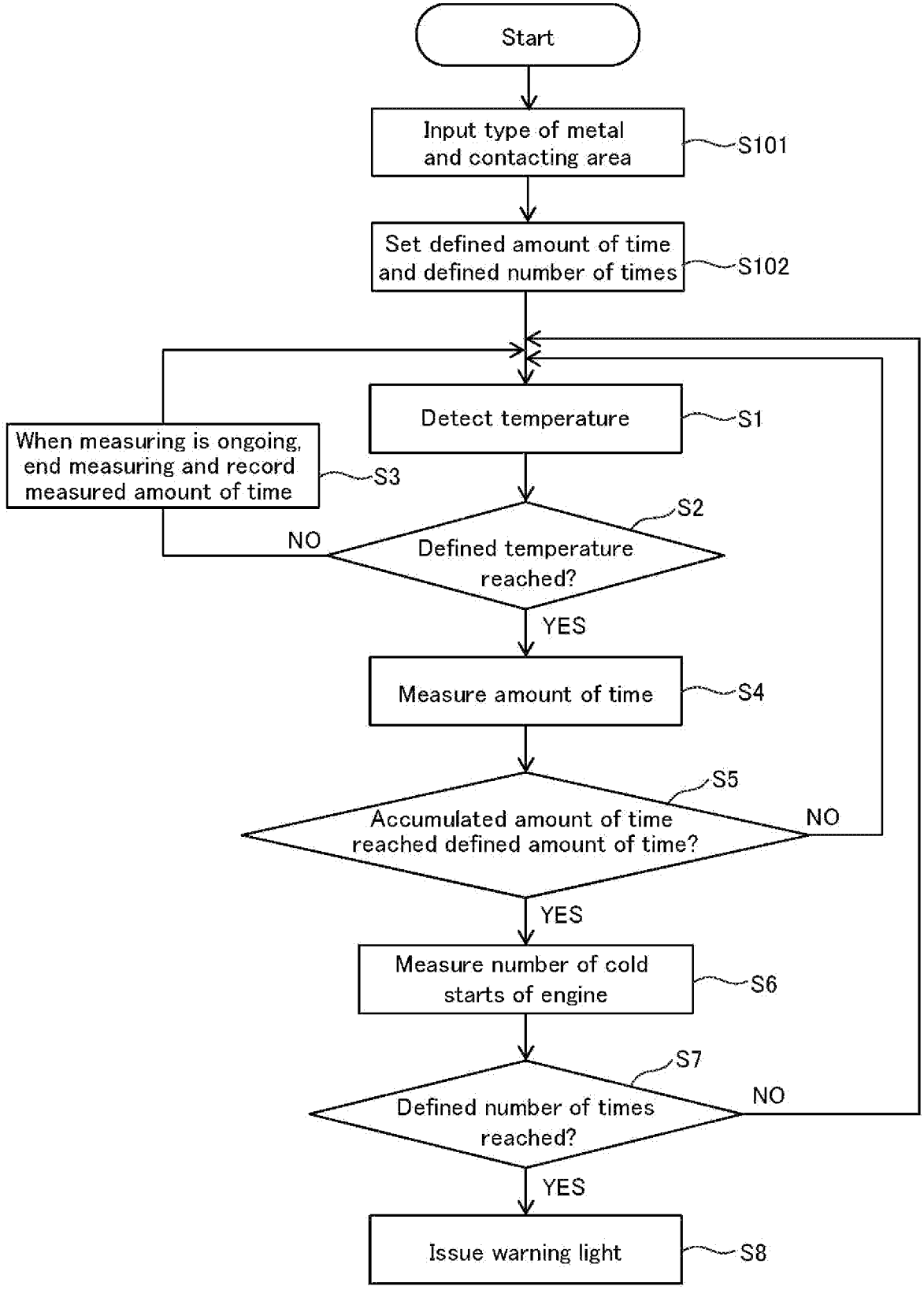
FIG. 8 is a flowchart showing the control of the internal combustion system according to the second embodiment.

FIG. 8 shows a flowchart showing the control of the internal combustion system according to the second embodiment. The difference from the first embodiment in the flowchart showing the control is that the second embodiment performs step S101 and step S102 first. The other portions of the flow of the control are the same as those of the first embodiment. Thus, the detailed description will be omitted herein.

First, in step S101, before or after externally inputting the coolant W to the internal combustion system (before the initial start of the engine 10), the type and contacting area of the metal of the flow channel 29 are input to the control device 40 via an input device (not shown). Then, in step S102, the setting unit 44 sets the defined amount of time and the defined number of times on the basis of the input type and contacting area of the metal. The same flow as that of the first embodiment follows thereafter.

In the present embodiment, the defined amount of time and the defined number of times are set in accordance with the type of metal forming the flow channel 29 where the coolant W flows and the contacting area of the metal of the flow channel 29 contacting the coolant W, so that the timing of exchanging the coolant W can be moved up than normal. Specifically, since the setting unit 44 sets the defined amount of time and the defined number of times so as to be reduced as the metal contacting the coolant W has a lower anticorrosiveness against the coolant W, the timing of exchanging the coolant W can be moved up than normal. As a result, the corrosion of the flow channel 29 caused by the coolant W oxidatively degraded can be reduced.

Likewise, since the setting unit 44 sets the defined amount of time and the defined number of times so as to be reduced as the contacting area of the metal of the flow channel 29 contacting the coolant W increases, the timing of exchanging the coolant W can be moved up than normal. Thus, the corrosion of the flow channel 29 caused by the coolant W oxidatively degraded can be reduced.

Third Embodiment

The internal combustion system according to a third embodiment will be described below. The difference from the first and second embodiment in the internal combustion system of the third embodiment is the control device. Therefore, the difference in the control devices will be described below with reference to FIG. 9 to FIG. 11.

Figure 9:
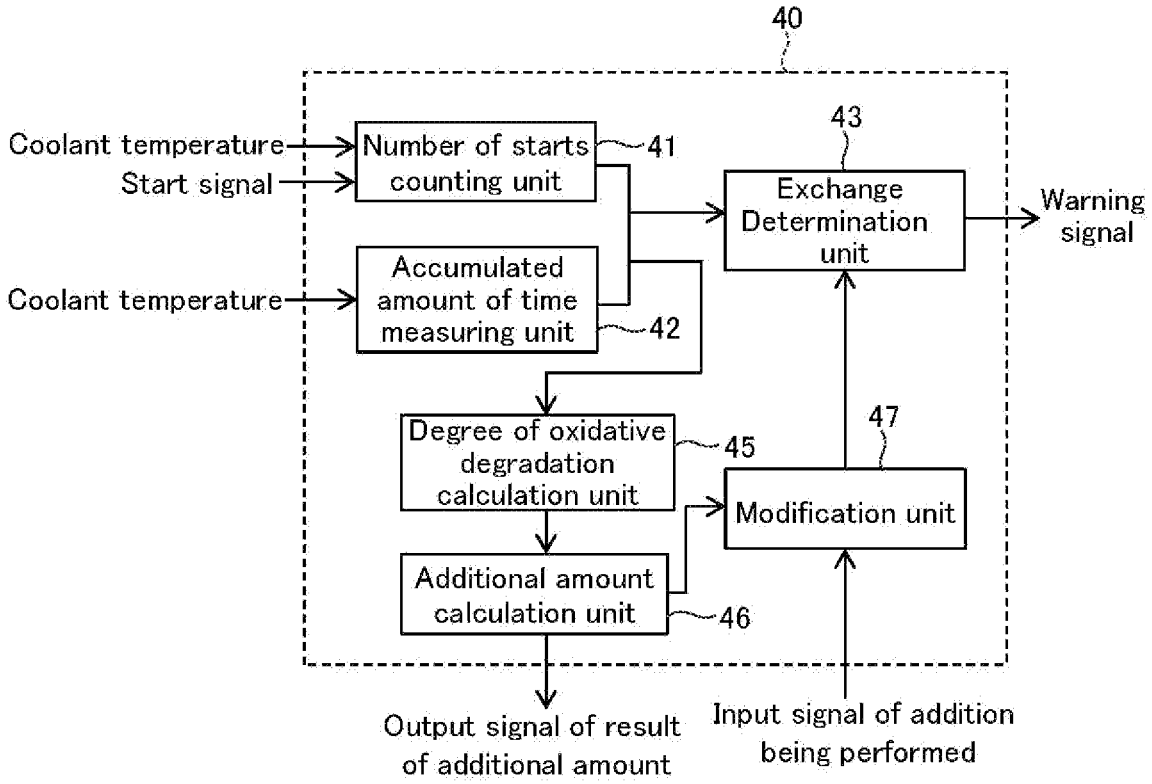
FIG. 9 is a block diagram showing the control of the internal combustion system shown in FIG. 1 according to the third embodiment.

As shown in FIG. 9, in this embodiment, the control device 40 includes a degree of oxidative degradation calculation unit 45, an additional amount calculation unit 46, and a modification unit 47. The degree of oxidative degradation calculation unit 45 calculates the degree of oxidative degradation of the coolant W on the basis of the accumulated amount of time measured by the accumulated amount of time measuring unit 42 and the number of cold starts counted by the number of starts counting unit 41.

Figure 3:
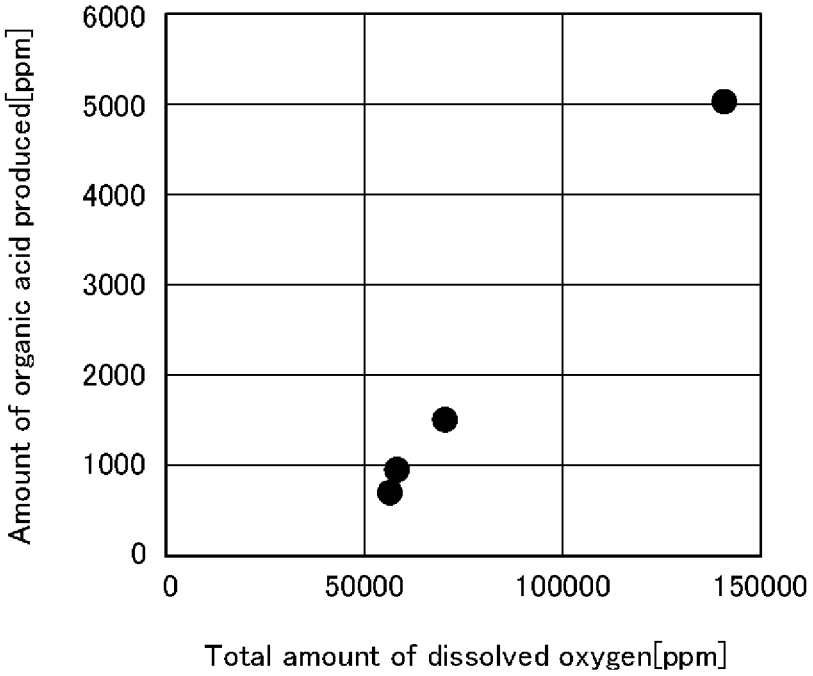
FIG. 3 is a graph showing the relation between a total amount of dissolved oxygen and an amount of an organic acid produced.

Specifically, as illustrated in FIG. 3 or the like, as the accumulated amount of time and the number of cold starts increase, the ethylene glycol is oxidized, and thus, the coolant W is oxidatively degraded. The degree of oxidative degradation of the coolant can be calculated by, for example, measuring a hydrogen ion exponent (pH) of the coolant W using a pH measuring instrument so as to associate the measurement with the plurality of conditions of the accumulated amount of time and the number of starts measured in advance. It should be noted that as the pH increases, the oxidative degradation more progresses, and thus, the degree of oxidative degradation becomes higher.

In addition, the accumulated amount of time and the number of starts measured in advance as a plurality of conditions, and the pH of the coolant under each of such conditions or the corresponding degree of oxidative degradation are used as teacher data so that the calculation of the pH or the degree of oxidative degradation may be machine-learned. Further, the calculation of the degree of oxidative degradation by the degree of oxidative degradation calculation unit 45 in the present embodiment may be performed on the basis of the hydrogen ion exponent measured by the pH measuring instrument, for example.

Herein, the coolant W acidifies when oxidatively degraded. When the degree of oxidative degradation is significant, the solution property of the coolant W is inclined toward a strong acid. As the oxidative degradation of the coolant W progresses, the corrosion of the wall surface of the flow channel 29 is promoted. Then, the additional amount calculation unit 46 calculates an additional amount of a neutralizer for neutralizing the acidity of the coolant W or an additional amount of an anticorrosive for the metal forming the flow channel 29 against the coolant W on the basis of the degree of oxidative degradation of the coolant W calculated by the degree of oxidative degradation calculation unit 45.

Figure 10:
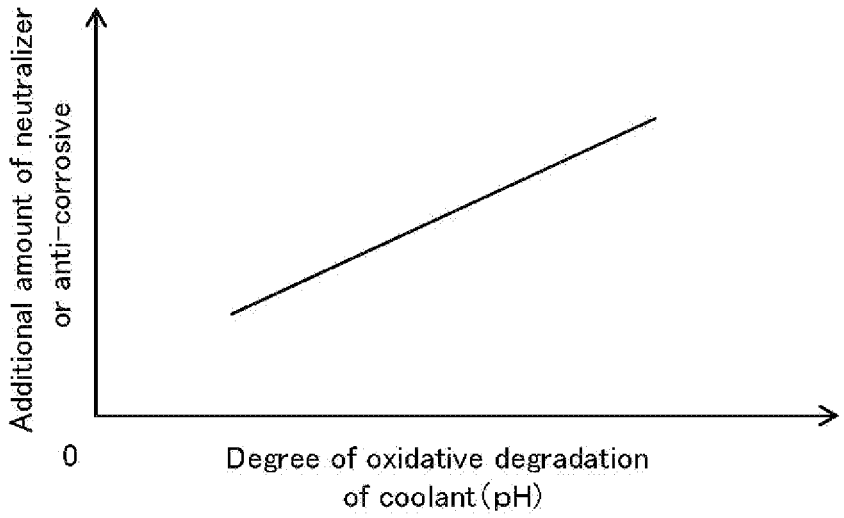
FIG. 10 is a conceptual graph showing the relation between the contacting area of the coolant, and the defined amount of time and the defined number of times.

Specifically, as shown in FIG. 10, the additional amount calculation unit 46 calculates the additional amount of the neutralizer or the anticorrosive so as to increase as the degree of oxidative degradation of the coolant W increases. The additional amount can be calculated using a formula or a table that specifies the relations between the additional amounts and the degrees of oxidative degradation. These relations can be obtained by conducting experiments or the like in advance.

The additional amount of the neutralizer can be calculated, for example, such that the addition of the neutralizer in the calculated amount brings the solution property of the coolant W to its initial solution property (which is neutral). Further, the additional amount of the anticorrosive can be calculated, for example, such that the concentration of the anticorrosive to be consumed in the coolant is recorded in advance for each degree of oxidative degradation by conducting experiments or the like and the additional amount calculation unit 46 can calculate the amount of the anticorrosive relative to the total amount of the coolant W so as to complement the reduced concentration of the anticorrosive.

After adding the neutralizer or the anticorrosive in the calculated amount, the modification unit 47 modifies the defined amount of time and the defined number of times on the basis of the additional amount. Specifically, since the addition of the neutralizer or the anticorrosive extends the usable period of the coolant W, the modification unit 47 modifies the defined amount of time and the defined number of times to be increased.

Figure 4:
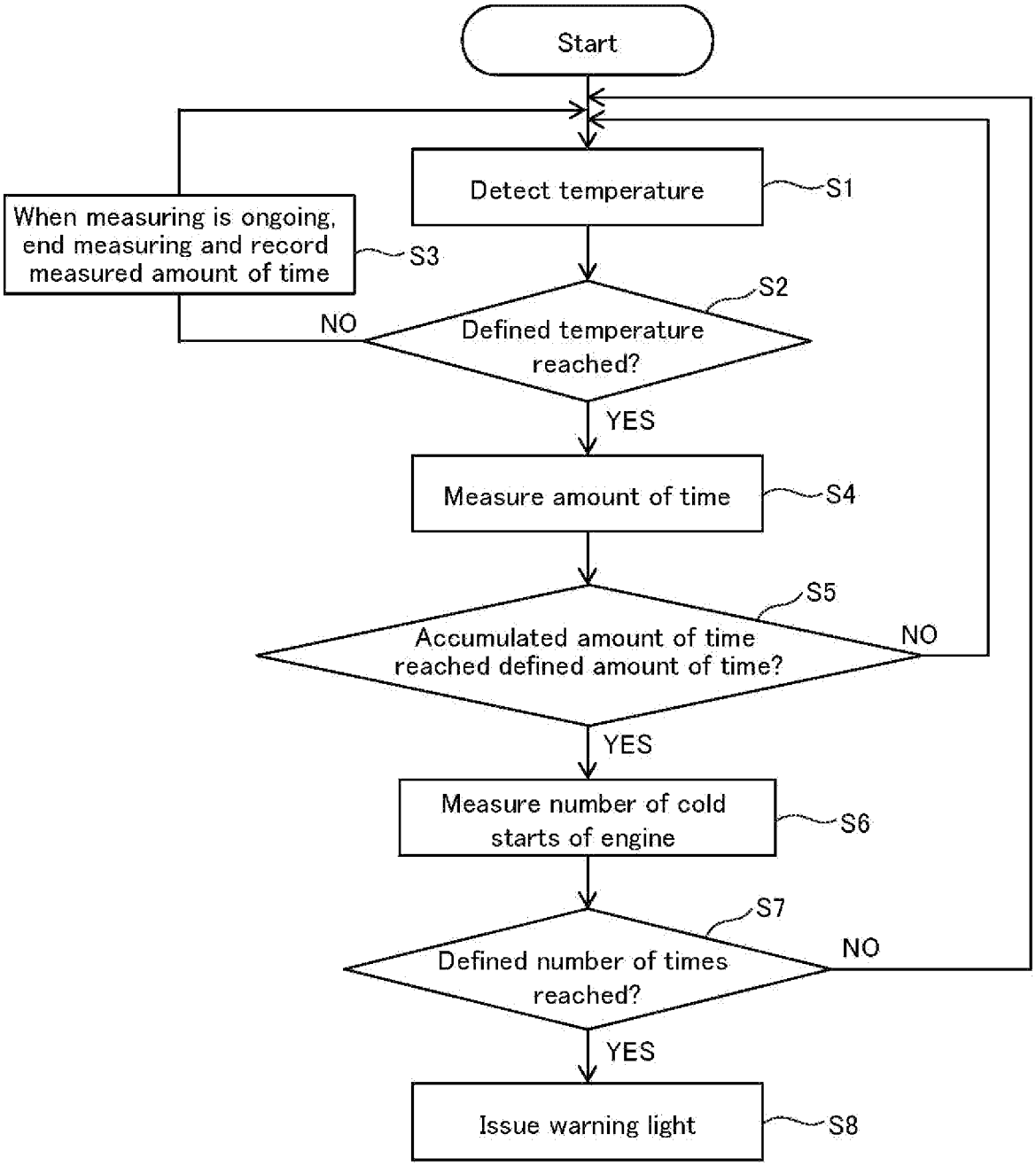
FIG. 4 is a flowchart showing the control of the internal combustion system according to the first embodiment.
Figure 11:
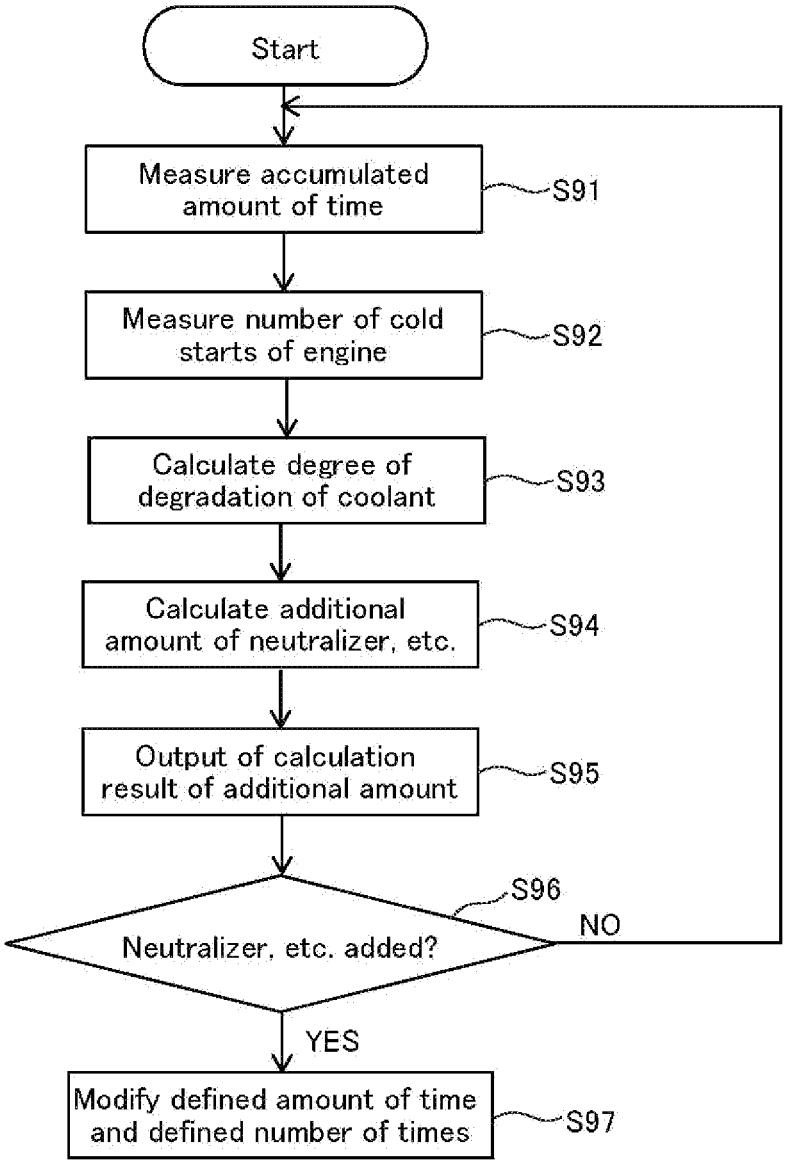
FIG. 11 is a flowchart showing the control of the internal combustion system according to the third embodiment.

FIG. 11 is a flowchart showing the control of the internal combustion system according to the third embodiment, and showing the flow that is performed alongside the flow of the control of the internal combustion system according to the first embodiment shown in FIG. 4. The flow is performed before step S8 shown in FIG. 4, that is, before determining that the coolant W needs to be exchanged.

First, in step S91, the accumulated amount of time measuring unit 42 measures the accumulated amount of time. In this step S91 the same processes as those in FIG. 4 from step S1 to step S4 are performed. Then, in step S92, the number of starts counting unit 41 determines the cold start of the engine 10 and counts the number of cold starts during the period until the coolant is exchanged.

In step S93, the degree of oxidative degradation calculation unit 45 calculates the degree of oxidative degradation of the coolant W on the basis of the accumulated amount of time and the number of cold starts, and the process then proceeds to step S94. In step S94, the additional amount calculation unit 46 calculates the additional amount of a neutralizer or an anticorrosive on the basis of the calculated degree of oxidative degradation of the coolant. In step S95, the result of the calculated additional amount is displayed on an output device (not shown) or the like.

In step S96, it is determined whether the neutralizer or the anticorrosive in the calculated additional amount has been added. For example, a pH measuring instrument may be provided in the flow channel 29 for the coolant W so as to determine whether the addition has been performed, on the basis of the change in the pH measured by the pH measuring instrument. As another way of determination, a sensor to measure the conductivity of the coolant W is provided, so that whether the addition has been performed may be determined on the basis of the change in the conductivity. In addition, when the neutralizer or the anticorrosive is added, the operator may transmit a signal indicating that the addition has been performed to the control device 40, so that whether the addition has been performed may be determined on the basis of the input signal (input signal indicating that the addition has been performed).

In step S96, when it is determined that the neutralizer or the anticorrosive has been added, in step S97, the modification unit 47 modifies the defined amount of time and the defined number of times. Meanwhile, when no addition of the neutralizer or the anticorrosive is determined, the process returns to step S91.

According to the present embodiment, the additional amount calculation unit 46 calculates the additional amount of the neutralizer or the anticorrosive on the basis of the degree of oxidative degradation of the coolant W. The addition of the neutralizer or the anticorrosive in such an additional amount can extend the usable period of the coolant so as to delay the timing of exchanging the coolant. In addition, with the addition of the neutralizer or the anticorrosive in such an additional amount, the varying exchange timing of the coolant W may be modified to be set at appropriate timing by modifying the defined amount of time and the defined number of times by the modification unit 47.

Although the embodiments of the present disclosure have been described in detail above, the present disclosure is not limited thereto, and any design changes can be made without departing the spirit of the present disclosure described in the claims.

The first embodiment shows an example of a single control device to be mounted on a vehicle, which performs the engine control, determination of the coolant exchange, and warning light control. However, the control of the warning light shown in FIG. 2 may be performed such that a control device is provided in an external management system of the vehicle so as to control the warning light through communication via the management system. In addition, the control device of the third embodiment may be provided with the setting unit of the second embodiment. Further, in the third embodiment, the ethylene glycol or additional coolant may be further added to the coolant when the neutralizer or the anticorrosive is added.

What is claimed is:

1. An internal combustion system, comprising:

an engine;

a cooling circulation mechanism that circulates a coolant to the engine while cooling the coolant, the coolant adapted to cool the engine and containing ethylene glycol; and a temperature sensor that measures a temperature of the coolant having passed through the engine, wherein:

the internal combustion system further includes a control device, the control device having:

a number of starts counting unit that determines a cold start of the engine and counts the number of cold starts during a period until the coolant is exchanged;

an accumulated amount of time measuring unit that measures an accumulated amount of time when the temperature of the coolant measured by the temperature sensor is equal to or higher than a defined temperature during the period until the coolant is exchanged; and an exchange determination unit that determines that the coolant needs to be exchanged, when the accumulated amount of time is equal to or greater than a defined amount of time and the number of cold starts is equal to or greater than a defined number of times.

2. The internal combustion system according to claim 1, wherein the coolant further contains an anticorrosive, and the control device further includes a setting unit that sets the defined amount of time and the defined number of times in accordance with a type of metal forming a flow channel where the coolant flows and a contacting area of the metal of the flow channel contacting the coolant.

3. The internal combustion system according to claim 1, wherein the control device further includes:

a degree of oxidative degradation calculation unit that calculates a degree of oxidative degradation of the coolant on the basis of the accumulated amount of time and the number of cold starts;

an additional amount calculation unit that calculates, on the basis of the degree of oxidative degradation, an additional amount of a neutralizer for neutralizing acidity of the coolant and an additional amount of an anticorrosive for the metal forming the flow channel against the coolant; and a modification unit that modifies the defined amount of time and the defined number of times on the basis of the additional amount of the neutralizer or the anticorrosive after addition of the neutralizer or the anticorrosive.

* * * * *